US012421723B2

(12) United States Patent
McElwee et al.

(10) Patent No.: US 12,421,723 B2
(45) Date of Patent: Sep. 23, 2025

(54) CEILING SYSTEM

(71) Applicants: Stephen McElwee, Toronto (CA); Aaron McElwee, Toronto (CA); Jeff Walz, Toronto (CA)

(72) Inventors: Stephen McElwee, Toronto (CA); Aaron McElwee, Toronto (CA); Jeff Walz, Toronto (CA)

( * ) Notice: Subject to any disclaimer, the term of this patent is extended or adjusted under 35 U.S.C. 154(b) by 238 days.

(21) Appl. No.: 18/311,432

(22) Filed: May 3, 2023

(65) Prior Publication Data

US 2024/0368883 A1 Nov. 7, 2024

(51) Int. Cl.
*E04B 9/00* (2006.01)
*E04B 9/24* (2006.01)

(52) U.S. Cl.
CPC ..... *E04B 9/242* (2013.01)

(58) Field of Classification Search
CPC ..... E04B 9/00; E04B 9/04; E04B 9/18; E04B 9/22; E04B 9/242; E04B 9/241; E04B 9/36
See application file for complete search history.

(56) References Cited

U.S. PATENT DOCUMENTS 3,303,338 A * 2/1967 Lyon ..... F21V 21/00 362/148
3,835,614 A * 9/1974 Downing, Jr. ..... E04B 9/122 52/666
4,290,218 A * 9/1981 Drueck, Jr. ..... G09F 19/22 362/396
4,438,613 A * 3/1984 Hintsa ..... E04B 9/14 52/800.11
6,318,042 B1 * 11/2001 Bloom ..... E04B 9/16 52/669
8,596,008 B2 * 12/2013 Waters ..... E04B 9/04 52/39
10,844,599 B2 * 11/2020 Rimmer ..... E04B 9/225
11,174,635 B1 * 11/2021 Monier ..... E04B 9/0414
11,879,250 B2 * 1/2024 Harnish ..... E04B 9/0464
2001/0048599 A1 * 12/2001 Hess ..... F21V 7/0016 362/342
2016/0265224 A1 * 9/2016 Byers ..... H01R 25/14
2018/0058068 A1 * 3/2018 Bergman ..... E04B 9/127
2019/0112809 A1 * 4/2019 Frantz ..... F24F 5/0021

* cited by examiner

*Primary Examiner* — Chi Q Nguyen
(74) *Attorney, Agent, or Firm* — Orin Del Vecchio

(57) ABSTRACT

A suspended ceiling system that is configured to provide coverage of a ceiling within a structure wherein the present invention includes a technique operable to employ a plurality of panels of alternate sizes and shapes to create a preferred design. The system includes a support grid wherein the support grid includes a multitude of support members arranged in a grid pattern. The support grid includes spaces configured to have mounted therein a plurality of first panels. The first panels are configured to have releasably secured thereto a plurality of second panels. The second panels are configured to be of a different size and shape than the first panels. The first panels include a plurality of mounting apertures that are operable to couple with securing members located on the upper surface of the second panels. The first panels further include at least one installation aperture formed therein.

10 Claims, 3 Drawing Sheets

CEILING SYSTEM

FIELD OF THE INVENTION

The present invention relates generally to construction products and techniques, more specifically but not by way of limitation, a suspended ceiling system that employs a first panel that is mounted within a support grid and a second panel configured to be releasably secured to the first panel wherein the second panel has a size and shape that is independent of the first panel and support grid.

BACKGROUND

As is known in the art, there are several types of ceiling and ceiling materials that are utilized in commercial and residential buildings. For residential buildings, the most common type of ceiling construction employs drywall that is secured to ceiling joists. While drywall is also utilized in commercial buildings, other types of ceiling materials and techniques are also utilized as access to the plenum above is more commonly required for maintenance on the building. Commercial buildings often utilize a suspended ceiling wherein the ceiling system includes a support grid wherein the grid is manufactured from a lightweight metal and suspended with suitable hardware. Conventional support grids are available with square or rectangular patterns that accommodate panels of the same size and shape.

While conventional suspended ceiling tile systems have proven effective there are design and appearance deficiencies intrinsic to the existing technology. Conventional suspended ceilings must utilize ceiling tiles that mateably couple with the voids in the support grid. Support grids are available in different sizes but existing support grids primarily are built to have rectangular or square spaces for the ceiling tiles. Furthermore, conventional ceiling tile material is manufactured from a paper and fibrous material and can be undesirable from a decorative perspective.

Accordingly, there is a need for a suspended ceiling tile system that is configured to have a first panel configured to mateably engage a ceiling support grid wherein the first panel is further configured to have a second panel releasably secured thereto wherein the second panel has a shape that is independent of the first panel and the spaces of the support grid.

SUMMARY OF THE INVENTION

It is the object of the present invention to provide a suspended ceiling tile system wherein the present invention includes a support grid suspended from a ceiling of a structure.

Another object of the present invention is to provide a ceiling tile system that provides a tile shape that is independent of the support grid of the ceiling system wherein the present invention includes a first panel wherein the first panel is configured to be mounted within the spaces of the support grid.

A further object of the present invention is to provide a suspended ceiling tile system wherein the first panel includes a plurality of mounting apertures formed therein.

Yet a further object of the present invention is to provide a ceiling tile system that provides a tile shape that is independent of the support grid of the ceiling system wherein the present invention includes a second panel that is configured to be releasably secured to the first panel.

Still another object of the present invention is to provide a suspended ceiling tile system wherein the second panel include a first surface and second surface wherein the second surface has retention clips secured thereto that are configured to operably couple with the mounting apertures of the first panel.

An additional object of the present invention is to provide a ceiling tile system that provides a tile shape that is independent of the support grid of the ceiling system wherein the second panel has a shape that is independent of the shape of the first panel and the spaces of the support grid.

Yet a further object of the present invention is to provide a suspended ceiling tile system wherein the second panel of the present invention is provided in a plurality of materials and colors.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
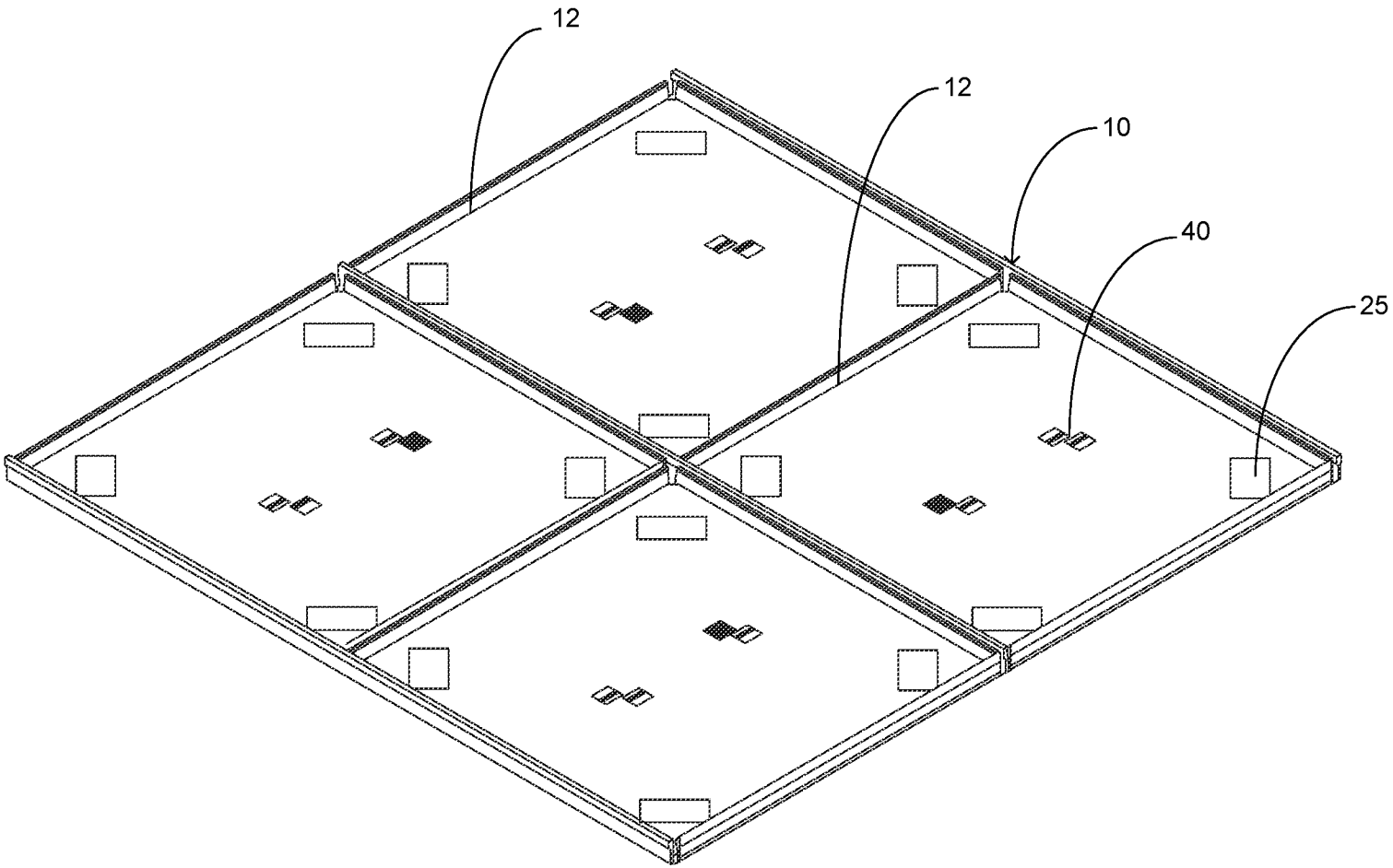
FIG. 1 is a top perspective view of the support grid and first panels of the present invention.
Figure 2:
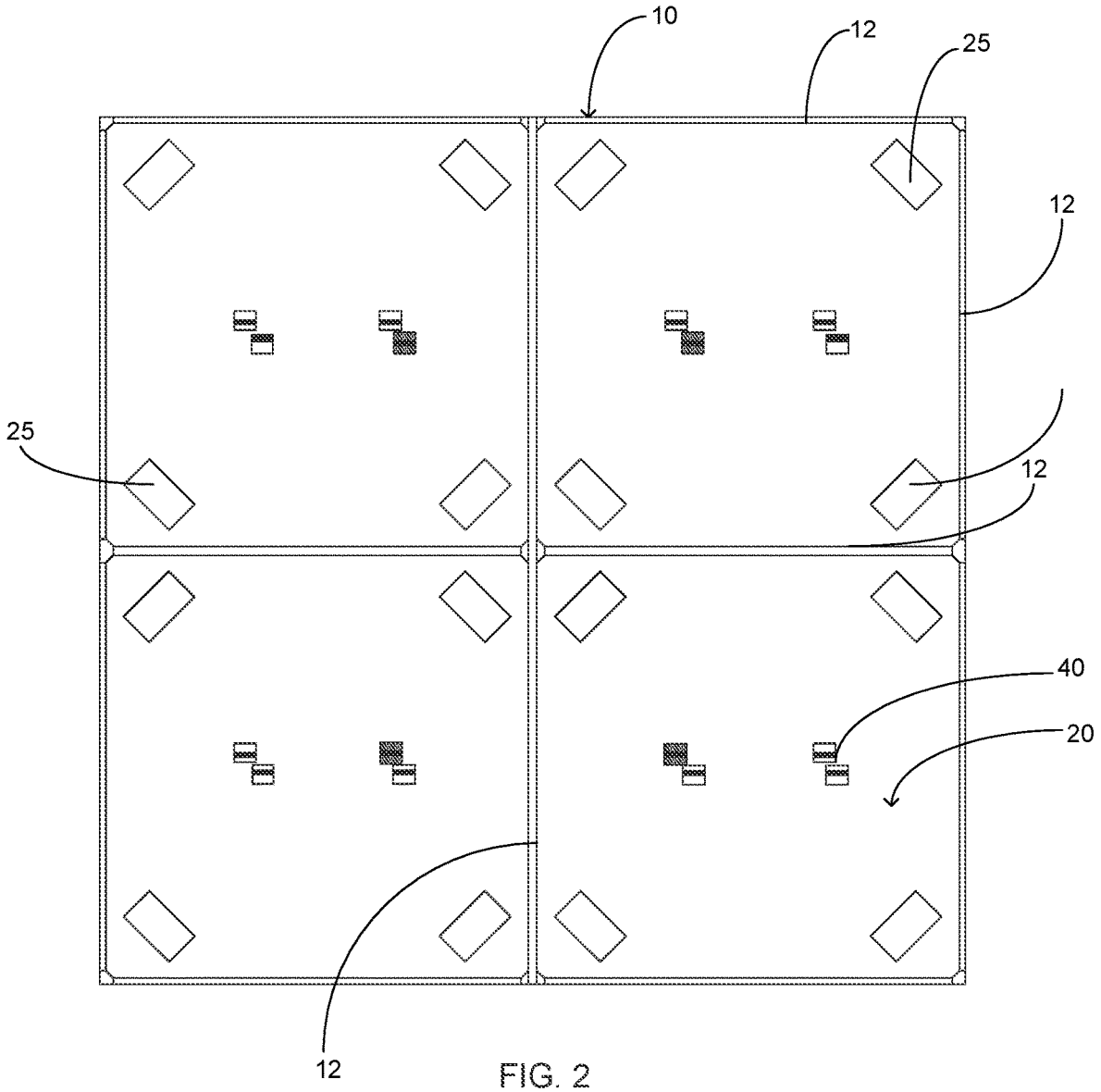
FIG. 2 is a bottom view of the first panels mounted into an exemplary section of the support grid.
Figure 3:
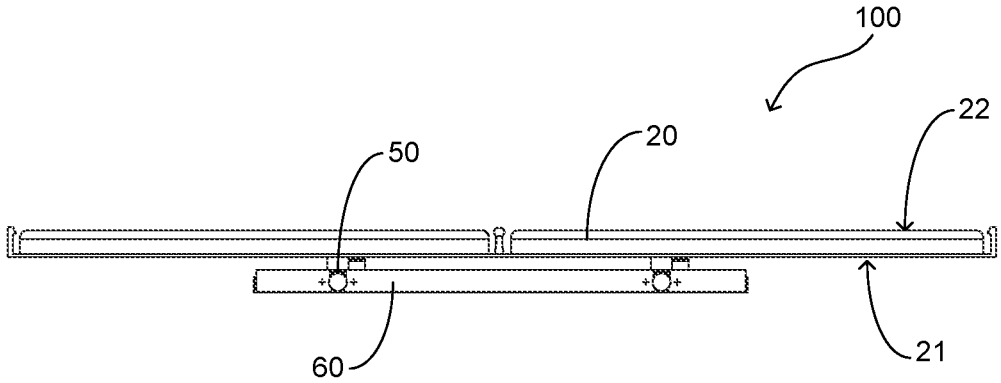
FIG. 3 is a side view of a second panel mounted to a first panel.
Figure 4:
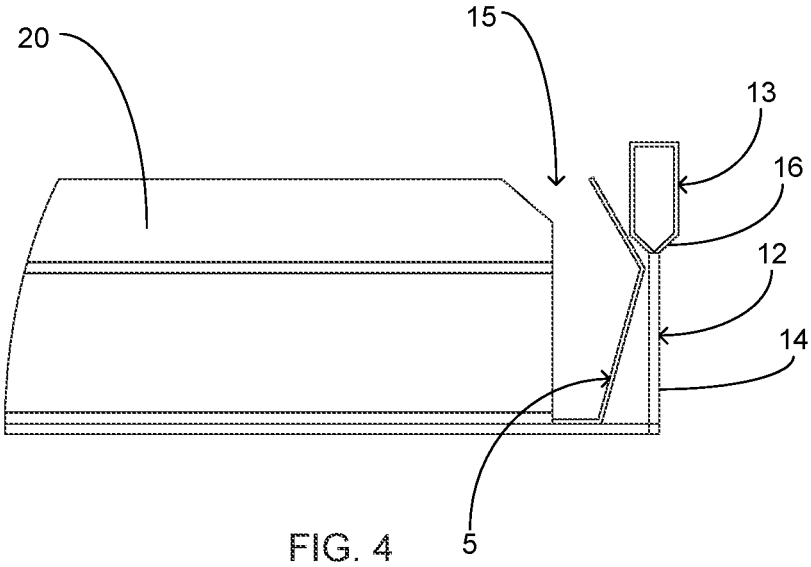
FIG. 4 is a detailed view of an exemplary mounting element for securing the first panel into the support grid.

Referring now to the drawings submitted herewith, wherein various elements depicted therein are not necessarily drawn to scale and wherein through the views and figures like elements are referenced with identical reference numerals, there is illustrated a suspended ceiling system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the suspended ceiling system 100 includes a support grid 10. The support grid 10 is suspended mounted from a ceiling of a structure utilizing suitable durable techniques. The support grid 10 is comprised of a plurality of support members 12 wherein the support members 12 are operably coupled to create spaces 15 configured to have the first panel 20 secured therein. It should be understood within the scope of the present invention that the support members 12 can be operably coupled to create alternate sizes and shapes of the spaces 15 so as to mateably accommodate the first panel 20. The support members 12 are manufactured from a lightweight rigid material such as but not limited to aluminum. The support members 12 include upper portion 13 wherein upper portion 13 has a width that is greater than the width of the lower portion 14. Upper portion 13 further includes lower angular surface 16 that is configured to engage clip member 5 of the first panel 20. The first panel 20 has secured to the perimeter edge thereof a clip member 5. Clip member 5 includes a first section 6 and a second section 7 wherein second section 7 is angularly oriented so as to mateably engage with the lower angular surface 16. Clip member 5 is manufactured from a resilient metal and is configured to bias against the upper portion 13 so as to releasably secure the first panel 20 within the support grid 10. It is contemplated within the scope of the present invention that the first panel 20 could be configured with a plurality of alternate elements in order to facilitate releasably securing thereof to the support grid 10. It should be understood within the scope of the present invention that the first panel 20 could be secured to the support grid 10 utilizing alternate techniques and further could be placed on the support grid in different locations.

The suspended ceiling system 100 includes a plurality of first panels 20. It should be understood within the scope of the present invention that the suspended ceiling system 100 can employ numerous alternate quantities of the first panels 20 based upon the size of the installation of the suspended ceiling system 100. Furthermore, it should be understood within the scope of the present invention that the first panels 20 could be provided in alternates sizes and shapes. The first panel 20 is manufactured from a lightweight rigid material and includes a lower surface 21 and an upper surface 22. The first panel 20 includes installation apertures 25 proximate the corners of the first panel 20. The installation apertures 25 are bored completely through the first panel 20 and are positioned at the corners proximate the perimeter edge of the first panel 20. The installation apertures 25 are sized so as to accommodate at least a portion of a human hand and are employed during the installation process of the first panels 20. The installation apertures 25 provide an element to grasp and manipulate the first panel 20 so as to place in the spaces 15 of the support grid 10. While four installation apertures 25 are desired in a preferred embodiment of the first panel 20, it is contemplated within the scope of the present invention that the first panel 20 could have as few as one installation apertures 25 or more than four installation apertures 25.

The first panel 20 includes a plurality of mounting apertures 40. The mounting apertures 40 are configured to operably couple with securing member 50 of the second panel 60. The mounting apertures 40 are journaled through the first panel 20 and of suitable size to accommodate the resilient securing member 50 in order to releasably secure the second panel 60 to the first panel 20. It is contemplated within the scope of the present invention that the first panel 20 could have as few as one mounting aperture 40 or a plurality of mounting apertures 40. Furthermore, it should be understood within the scope of the present invention that the mounting apertures 40 could be placed in numerous alternate locations on the first panel 20.

The suspended ceiling system 100 includes a plurality of second panels 60. It should be understood within the scope of the present invention that the suspended ceiling system 100 could employ numerous alternate quantities of the second panel 60. Furthermore, it should be understood within the scope of the present invention that the second panel 60 is of a different size and shape than the first panel 20 and the second panel 60 is provided in a plurality of alternate sizes and shapes. The second panel 60 includes a securing member 50 on the upper surface thereof. Ensuing the mounting of the first panels 20 to the support grid 10, the second panels 60 are releasably secured thereto. It should be understood within the scope of the present invention that the second panels 60 could be releasably secured to the first panel 20 utilizing alternate elements in addition to and/or in conjunction with the securing member 50. The second panel 60 is equipped with sufficient securing members 50 so as to be releasably secured to the first panels 20 in the desired orientation. In a preferred embodiment of the present invention, the suspended ceiling system 100 employs a plurality of second panels 60 that are of a different size and shape than the first panel 20 in order to create a more desirable cosmetic appearance of the ceiling ensuing installation of the suspended ceiling system 100. It should be further understood within the scope of the present invention that the second panels 60 can be manufactured from various alternate materials.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A suspended ceiling system comprising:

a support grid, said support grid including a plurality of support members, said support members being operably coupled to create consistent shaped spaces therebetween;

a plurality of first panels, said plurality of first panels having an upper surface and a lower surface, said plurality of first panels having a perimeter edge, said plurality of first panels having a shape so as to be releasably secured to a first side of the support grid, said plurality of first panels having at least one mounting aperture;

a plurality of second panels, said plurality of second panels having an upper surface and a lower surface, said plurality of second panels having at least one securing member located on the upper surface thereof, said at least one securing member configured to operably couple with said at least one mounting aperture so as to releasably secure the plurality of second panels adjacent to the plurality of first panels such that the support grid is positioned between the plurality of first panels and the plurality of second panels;

and the second panel is releasable from the first panel without accessing the first panel, wherein the plurality of second panels are of a different size and shape than the plurality of first panels.

2. The suspended ceiling system as recited in claim 1, and further including at least one installation aperture, said at least one installation aperture being formed in said plurality of first panels.

3. The suspended ceiling system as recited in claim 2, wherein said plurality of support members include a lower portion and an upper portion, said upper portion having a width greater than that of the lower portion.

4. The suspended ceiling system as recited in claim 3, wherein said plurality of first panels include a clip member, said clip member being formed via folding of the perimeter edge thereof, said clip member configured to releasably secure said plurality of first panels to the support members of the support grid.

5. The suspended ceiling system as recited in claim 4, wherein said at least one installation aperture is proximate the perimeter edge of the plurality of first panels.

6. A suspended ceiling system operable to provide a technique to create alternate arrangements of patterns for second panels thereof wherein the suspended ceiling system comprises:

a support grid, said support grid including a plurality of support members, said support members being operably coupled to create consistent shaped spaces therebetween;

a plurality of first panels, said plurality of first panels having an upper surface and a lower surface, said plurality of first panels having a perimeter edge, said plurality of first panels having a shape so as to be releasably secured within the spaces of the support grid, said plurality of first panels having a plurality of mounting aperture, said plurality of mounting apertures located in alternate locations on the plurality of first panels, said plurality of first panels further including four installation apertures, said four installation apertures being located proximate corners of the plurality of first panels;

a plurality of second panels, said plurality of second panels having an upper surface and a lower surface, said plurality of second panels having a plurality of securing members located on the upper surface thereof, said plurality of securing members configured to operably couple with said plurality of mounting aperture so as to releasably secure the plurality of second panels adjacent to the plurality of first panels; and wherein the plurality of second panels are of a different size and shape than the plurality of first panels.

7. The suspended ceiling system operable to provide a technique to create alternate arrangements of patterns for second panels thereof as recited in claim 6, wherein the plurality of first panels perimeter edges fold upwards to form a clip member, said clip member being configured to releasably secure the plurality of first panels to the support grid.

8. The suspended ceiling system operable to provide a technique to create alternate arrangements of patterns for second panels thereof as recited in claim 7, wherein said four installation apertures are angularly oriented with respect to the corners of the plurality of first panels.

9. The suspended ceiling system operable to provide a technique to create alternate arrangements of patterns for second panels thereof as recited in claim 8, wherein said plurality of securing members extend upward from the upper surface of the plurality of second panels.

10. The suspended ceiling system operable to provide a technique to create alternate arrangements of patterns for second panels thereof as recited in claim 9, wherein the plurality of second panels are manufactured from a different material than the plurality of first panels.

* * * * *